8-107 SR
FIP8309 OR 4,077,768

United States Patent [19]
Johnston et al.

[11] 4,077,768
[45] Mar. 7, 1978

[54] INHIBITING DYE TRANSFER IN WASHING OR BLEACHING

[75] Inventors: James Pyott Johnston, Cincinnati, Ohio; John Robert Tate, deceased, late of Whitley Bay, England, by Mary Tate, administrator; by Sidney Alfred Tate, administrator, Bolden Colliery, England

[73] Assignee: The Procter & Gamble Company, Cincinnati, Ohio

[21] Appl. No.: 697,006

[22] Filed: Jun. 17, 1976

[30] Foreign Application Priority Data

Jun. 20, 1975 United Kingdom ..... 26337/75

[51] Int. Cl.[2] ..... D06L 3/00
[52] U.S. Cl. ..... 8/107; 8/111; 252/95

[58] Field of Search ..... 8/107, 111, 1 XA, 137; 252/95, 186

[56] References Cited

U.S. PATENT DOCUMENTS

| | | | |
|---|---|---|---|
| 2,662,897 | 12/1953 | Pedersen | 260/314.5 |
| 3,156,654 | 11/1964 | Konecng et al. | 8/111 |
| 3,532,634 | 10/1970 | Woods | 252/95 |
| 3,847,830 | 11/1974 | Williams et al. | 252/186 |
| 3,927,967 | 12/1975 | Speakman | 8/107 |
| 3,951,840 | 4/1976 | Fujino et al. | 252/186 |

FOREIGN PATENT DOCUMENTS 1,182,143 2/1970 United Kingdom.

OTHER PUBLICATIONS

Diserens, The Chem. Techn. of Deying & Printing, 1948, Reinhold Publ. Co. p. 419.
Martell et al., Chemistry of the Metal Chelate, 1956, Prentice Hall, pp. 336–338, 359–361 and 373–379.
Heinz et al., Activators & Catalysts for Oxidation with Hydrogen Peroxide–Henkel referate 1973, pp. 28–33.
Schumb et al., Hydrogen Peroxide, Am. Chem. Society, 1955, pp. 416–425, 575.

*Primary Examiner*—William E. Schulz
*Attorney, Agent, or Firm*—Steven J. Goldstein; Robert B. Aylor; Thomas H. O'Flaherty

[57] ABSTRACT

A process for washing or bleaching textiles in which "dye transfer" is inhibited by the use of an oxidizing bleaching agent together with a catalytic compound, such as iron phorphins, haemin chloride or iron phthalocyanines. Compositions for use in this washing or bleaching process are also taught.

28 Claims, No Drawings

INHIBITING DYE TRANSFER IN WASHING OR BLEACHING

This invention relates to a process for decolorizing dyes in aqueous dispersions, especially in aqueous wash liquors, and to compositions for use in carrying out the process.

One of the more refractory problems in domestic washing procedures is the staining of fabrics by fugitive dyes from other fabrics in the same wash. This is the problem known as "dye transfer". It will be convenient, herein, to include within the meaning of this term the transfer of coloring matter in the "dirt" on fabrics which may likewise be transferred to other articles in the wash.

One way of overcoming this problem would be to bleach the fugitive dyes washed out of dyed fabrics while in the wash liquor, and before they have an appreciable opportunity to become attached to other articles in the wash. Clearly it would be important not at the same time to bleach the dyes actually remaining on the fabrics, that is, not to cause color damage.

For many years detergent compositions have contained bleaching agents to decolorize stains such as tea, coffee, wine and fruit stains on household laundry. Most commonly sodium perborate or like compounds (salts) which release hydrogen peroxide in the wash liquor have been used. These compounds are effective bleaches mainly at high washing temperatures near the boil. Persulfates, e.g. Oxone (Trade Name), although sometimes deemed low temperature bleaches, in fact have little effect at low temperatures in washing conditions and may be included in this class.

As most colored articles are not washed at such temperatures, these bleaches in practice seldom harm dyed fabrics, but they are not effective dye-transfer-inhibitors at temperatures at which colored fabrics are washed.

Hydrogen-peroxide-releasing bleaching agents can be made more effective at lower temperatures by adding "activators", which are usually organic acid anhydrides, esters or imides. These activators have to be present in about the same molar proportion as the perhydrate bleaching agent and are not regenerated in use. Thus they are not catalysts. Furthermore the activated bleaching agents attack intentional colors (dyes) as well as unintentional colors (stains) on fabrics, and yet, perhaps because their action upon dispersed or dissolved dyes is too slow, they are not very effective as dye transfer inhibitors.

Again, low-temperature bleaching can be effected using more aggressive oxidizing agents, such as percarboxylic acid bleaches. These may cause color damage and even damage to some fibers, and yet are not very effective dye transfer inhibitors. Chlorine bleaches are reasonably effective dye transfer inhibitors, but are generally very harmful to colored fabrics.

A method has now been found of increasing the effectiveness of hydrogen peroxide, agents which form it, and of other oxidizing bleaches, and, in particular, a method of very greatly increasing the rate at which they oxidize oxidizable dyes and stains dispersed or dissolved in water, yet without causing appreciable bleaching of dyes on or in fabrics. This is achieved by using certain iron porphin or azaporphin derivatives which are true catalysts for the bleaching agents, that is, they are regenerated in use and can therefore be used at quite low levels. Although we do not wish to be bound by theory, it appears that the active oxidizing species is an oxidized form of the catalyst. This apparently provides exceedingly rapid bleaching of dyes in solution, but, partly because it is a big molecule, and partly by selecting charged substituents in it, attack on dyes adsorbed on or absorbed in fibers is prevented. This same reasoning may explain the observed fact that these catalysts though generally themselves colored, do not noticeably stain fabrics when used as described herein.

According to the invention there is provided a process for washing fabrics which comprises treating them in a bath containing a dissolved or solubilized compound selected from:

(a) iron porphin and water-soluble or water-dispersible derivatives thereof;

(b) haemin chloride and water-soluble or water-dispersible derivatives thereof; and (c) iron phthalocyanine and water-soluble or water-dispersible derivatives thereof, to which bath is also supplied an oxidizing bleach agent, the concentration of said compound being up to $10^{-4}$ molar preferably $10^{-6}$ to $10^{-4}$ molar and the amount of said bleaching agent supplied being equal to the amount which would give a concentration in the bleaching bath of from $5 \times 10^{-5}$ to $10^{-2}$ molar, especially $5 \times 10^{-4}$ to $1.5 \times 10^{-3}$ molar, said bleaching agent or the active principle thereof being released into the bleaching bath, after at least part of said compound has been dissolved or solubilized, at a rate not substantially greater than that at which it is removed from said bath by reaction with the contents thereof.

In its compositional aspect, the invention provides a washing composition comprising an oxidizing bleach agent and, as catalyst therefor, a compound (a), (b) or (c) as defined above, or a mixture of such compounds, the bleaching agent being in a form such that it or its active principle is released into the bleaching solution at a rate not substantially greater than that at which it is removed by reaction with the contents thereof.

As used herein, the term "bleaching agent" includes those compounds which are, themselves, bleaching agents, and those whose active principle acts as a bleaching agent when put in an aqueous solution.

The essential iron porphin structure may be visualized as indicated in Formula I in the accompanying drawings. In Formula I the atom positions of the porphin structure are numbered conventionally and the double bonds are put in conventionally. In other formulae, the double bonds have been omitted in the drawings, but are actually present as in I.

Preferred iron porphin structures are those substituted at one or more of the 5, 10, 15 and 20 carbon positions of Formula I (Meso positions), with a substituent selected from the group consisting of

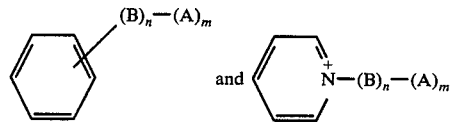

wherein $n$ and $m$ may be 0 or 1; A may be sulfate, sulfonate, phosphate or carboxylate groups; and B is $C_1$–$C_{10}$ alkyl, polyethoxy alkyl or hydroxy alkyl. Preferred molecules are those in which the substituents on the phenyl or pyridyl groups are selected from the group consisting of , $-CH_3$, $-C_2H_5$, $-CH_2CH_2CH_2SO_3^-$, $-CH_2--$, and $-CH_2CH(OH)CH_2SO_3^-$.

A particularly preferred iron porphin is one in which the molecule is substituted at the 5, 10, 15 and 20 carbon positions with the substituent

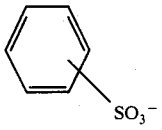

This preferred compound is known as ferric tetrasulfonated tetraphenylporphin.

The symbol X of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

FORMULA I

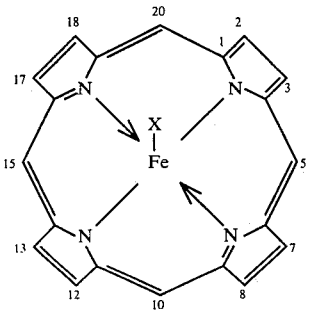

Compounds of class (b) are based upon haemin chloride which has the structure given in Formula II. Suitable derivatives include compounds wherein the propionic acid groups are ethoxylated. Compounds of class (c) have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are Fe(III) phthalocyanine trisulfonate and Fe(III) phthalocyanine tetrasulfonate.

FORMULA II

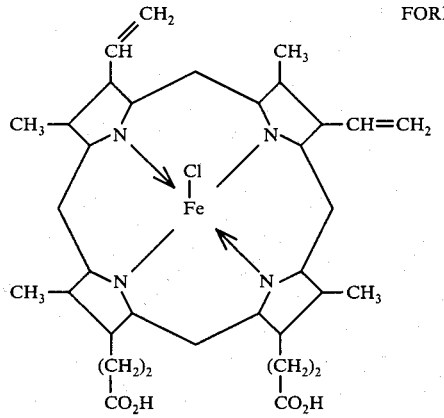

-continued

FORMULA III

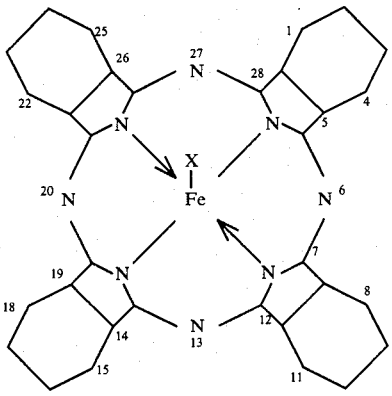

A number of considerations are significant in selecting variants of or substituents in the basic porphin or azaporphin structure. In the first place, one would choose compounds which are available or can be readily synthesized. Beyond this, choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas the cationic or zwitterionic compounds may be attracted to, or at least not repelled by, such stained surfaces.

The mode of action of the catalysts of the invention is not fully understood. However, it appears that in the presence of hydrogen peroxide or other oxidizing principle the catalyst forms an intermediate substance. This can react with substances able to be oxidized and bleached, whereby the original catalyst is reformed, and this is the desired reaction. However, the intermediate substance can also react with hydrogen peroxide, forming molecular oxygen which is ineffective as a bleaching agent, and which destroys unchanged catalyst. It is therefore necessary that so far as possible only enough hydrogen peroxide or other bleaching principle be present in the bleaching bath to react with the dyes. Accordingly a feature of the process and compositions of the invention is that the bleaching agent or the active principle thereof be released into the bleaching bath, after at least part of the catalyst compound has been dissolved or solubilized, the release of said agent or active principle being at a rate not substantially greater than that at which it is removed from said bath by reaction with substances therein. How quickly the oxidizing agent should be allowed to come into solution in the dye bath depends upon the particular conditions of use in which the invention is applied, however, the release should be controlled so that the oxidizing agent is introduced into solution throughout the period that dye-transfer may take place. Gradual introduction of hydrogen peroxide over a period of at least 5 minute, e.g. 5 to 30 minutes, appears to be suitable in ordinary domestic washing conditions.

The rate at which the bleaching agent or the active principle thereof is made available may be controlled in any way. Thus, the bleaching agent, for instance hydrogen peroxide, or solid or liquid agents, may be simply added gradually to the bleaching bath. Thus, at small scale, a drip feed of a liquid is suitable. More conveniently for using the invention in domestic or commercial conditions, the bleaching agent may be incorporated in a bleaching product in some form such that it dissolves in the bath at a controlled rate. Various agglomerating, noodling and coating techniques known to those skilled in the art can be applied to this end. Examples of such techniques are found in British Pat. No. 1,424,406. Coating a persalt, such as sodium perborate, with tallow alcohol has proved effective, using, for instance, about 10–20% tallow alcohol by weight of the sodium perborate. An interesting variant of this technique is to ensure slow release of perhydrate at temperatures below about 60° C, to permit optimum dye transfer inhibition when a product is used at these temperatures, but to employ a coating which releases the remaining perhydrate at higher temperatures so that it inactivates the catalyst and the remainder exerts its full direct bleaching effect without deliberate delay when a product is used for high temperature washing. This technique is valuable especially for application in a commercial product intended to be used both for low-temperature and high-temperature wash cycles.

The preferred bleaching agents for the method and compositions of the invention are hydrogen peroxide itself (when practicable) and persalts, such as sodium or potassium perborate, percarbonate, and perpyrophosphates. Lithium, calcium, or magnesium salts of these and other persalt bleaching agents may also be used. These compounds when catalysed become very effective dye transfer inhibitors, and yet cause practically no attack on dyes actually on fabrics. The catalysts also render other stronger oxidizing agents, such as activated perhydrates, persulphates, organic peroxides, peroxy acids and chlorine bleaches, effective as dye transfer inhibitors, but, of course they cannot take away the intrinsic tendency of some of these substances to attack dyes on fabrics. The washing process is preferably carried out at 5° to 75° C, especially 30° to 60° C, but the catalysts are effective at up to about 95° C. The pH of the treatment solution is preferably from 7 to 11, especially from 9 to 11.

In that these porphin-like compounds are true catalysts, quite small proportions thereof are effective. Thus the molar ratio of oxidizing agent to catalyst compound is preferably from 5:1 to 10,000:1, more especially about 10:1 to 100:1.

The process of the invention is conveniently carried out in the course of washing process, and the bleach baths, as well as the compositions of the invention, can contain the usual components of detergent compositions in the usual amounts. Thus organic detergents, anionic, nonionic, ampholytic, or zwitterionic or less usually cationic, and mixtures thereof, may be present. Suitable detergents are well known in the art and an extensive list of such compounds is given in U.S. Pat. No. 3,717,630, Booth, issued Feb. 20, 1967, incorporated herein by reference, and in U.S. patent application Ser. No. 589,116, filed June 23, 1975. Detergency builders, whether inorganic or organic, phosphatic or not, water-soluble or insoluble, and other water-soluble salts may be present, and salts of this sort may be employed whether organic detergents are present or not, for instance to control the pH of the bleaching bath. A description of suitable builders is given in U.S. Pat. No. 3,936,537, Baskerville et al., issued Feb. 3, 1976 incorporated herein by reference, and in U.S. patent application Ser. No. 589,116 filed June 23, 1975. Other components used in detergent compositions may be employed, such as suds boosting or depressing agents, enzymes and stabilizers or activators therefor, soil-suspending agents, soil-release agents, optical brighteners, abrasives, bactericides, tarnish inhibitors, coloring agents, and perfumes. These components, particularly the enzymes, optical brighteners, coloring agents, and perfumes, should preferably be chosen such that they are compatible with the bleach component of the composition. Antioxidants should preferably be absent.

In detergent compositions intended for use at the usual concentrations, e.g. from 0.02 to 2% by weight, preferably from 0.1 to 1% by weight, a content of from 0.01 to 3% available oxygen may be appropriate, preferably at the lower end of the range, for instance from 0.01 to 1%. That is somewhat lower than is normal in compositions containing perhydrates which do not contain the catalysts of the invention.

Detergent compositions useful in the present invention contain from about 1 to about 95%, preferably from about 5 to about 40% of a nonionic, anionic, zwitterionic, or ampholytic surfactant or mixtures thereof, together with from 0 to about 50%, preferably from about 5 to about 40% of a detergent builder. The compositions contain sufficient bleaching agent, in slow release form, such that the available oxygen content of the composition is from about 0.01 to about 3%, preferably from 0.01 to about 1%, and catalyst compound, such that the molar ratio of bleaching agent to catalyst compound is from about 5:1 to about 10,000:1, preferably from about 10:1 to 100:1.

The process and compositions of the invention are effective in inhibiting the transfer of dyes of many sorts, both direct dyes and disperse dyes, and indeed of substantially all dyes which are not too resistant to oxidative bleaching. Obviously, since the fugitive dyes are decolorized by oxidation, the treatment will not affect dyes which cannot be oxidized.

The invention is illustrated by the following nonlimiting Examples.

EXAMPLE 1

Homogeneous Polar Blue Bleaching

A solution (100ml) of Geigy Polar Brilliant Blue dye (Color Index 61135) ($6 \times 10^{-5}$M) and a ferric tetrasulfonated tetraphenylporphin catalyst ($1 \times 10^{-5}$M) was made and its pH value and temperature adjusted to 10° and 25° C respectively. The absorbance of this solution at 620 nm, a measure of the Polar Blue dye concentration, was 0.95 in a 1 cm cell. Hydrogen peroxide (1 ml of a $5 \times 10^{-2}$M solution) at pH 10 was added dropwise to the stirred solution over a period of five minutes. The absorbance at 620 nm of the resultant solution decreased steadily with increasing hydrogen peroxide addition to a final value of 0.2. This corresponded to almost total oxidation of the Polar Blue dye.

Blank experiments indicated that no oxidation of the Polar Blue dye occurred over the same time period (as evidenced by no change in absorbance at 620 nm)

(a) in the absence of the catalyst; and (b) when the hydrogen peroxide solution was added in one aliquot to the catalyst Polar Blue solution at the beginning of the experiment.

EXAMPLE 2

Small Scale Washing Tests

"Tracer" cloths (4½inches × 1 inch) stained with Durazol Red Dye 2B (Color Index 28160) and white terry towelling swatches (3 inches × 2 inches) were washed together, at 50° C for 20 minutes using 3.6 g per liter of a composition comprising by weight:

11.0% sodium dodecyl benzene sulfonate
42.0% sodium tripolyphosphate
6.3% sodium silicate
11.3% sodium sulfate
1.1% sodium toluene sulfonate Balance water and impurities.

In addition there were added in various treatments:

(a) nothing,
(b) 34 ppm $H_2O_2$,
(c) 11 ppm Ferric tetrasulfonated tetraphenyl porphin (abbreviated Fe(III) TPPS) then 34 ppm $H_2O_2$ added dropwise during 20 minutes,
(d) sodium perborate equivalent to 34 ppm $H_2O_2$,
(e) 11 ppm Fe(III)TPPS then sodium perborate dissolved in water and added dropwise during 20 minutes, and
(f) 11 ppm Fe(III)TPPS and perborate coated with 10% by weight of tallow alcohol.

It was observed after treatments (a), (b) and (d) that the test fabrics were clearly colored pink. After treatments (c) and (e) no visible coloring had been transferred, and after treatment (f) very slight transfer was observed. It was observed that subsequently washing the stained swatches from treatments (a), (b) or (d) in the conditions of treatments (c), (e) or (f) did not remove the staining, demonstrating that dyes on the fabrics are not attacked.

EXAMPLE 3

Test in Domestic Washing Machine

Colored fabrics from a bundle of naturally soiled domestic laundry were washed in an automatic washing machine employing the 40° C cycle with cold water rinses. White desized terry towels ("bath" size) were used as "tracers".

Method

Each bundle of laundry was halved as fairly as possible, and one half washed with test product and the other with a comparative product. The tracers from each load were then transferred into the other load, and each load was washed with the reversed product from what had been used in the first wash. Thus tracers were first washed in dirty load A with test product, then in once-washed load B with test product. This arrangement balanced out any difference due to unfair halving of the original laundry bundle.

The test was repeated with the same tracers, using a second bundle of soiled laundry. The tracer towels were visually examined after the test.

Detergent Composition 11.0% sodium dodecyl benzene sulfonate
4.0% tallow alcohol with 11 molar proportions of ethylene oxide
5.0% sodium soap
44.0% sodium tripolyphosphate
10.0% sodium silicate
14.0% sodium sulfate
1.0% carboxymethylcellulose
8.0% water Balance minor components and impurities.

Wash solutions employed were:

A — Test Solution —
10 ppm Fe(III)TPPS
0.4% detergent composition
0.004% sodium perborate B — Comparative Solution — As for A but without the Fe(III)TPPS The sodium perborate was coated with 10% by weight of tallow alcohol.

The tracer towels from the wash with Composition B were considerably and unevenly stained, those from the wash with composition A were substantially completely unstained.

EXAMPLE 4

Homogeneous dye bleaching with various bleaching agents

An aqueous solution was prepared in which the concentration of Fe(III)TPPS was $10^{-5}$ molar and the concentration of Durazol red dye was $3 \times 10^{-5}$ molar. The pH of the solution was adjusted to 10 and the spectrum viewed in the visible region, the Soret peak due to the Fe(III)TPPS being at a wavelength of 414nm and the dye absorption maximum occurring at 507nm. Hydrogen peroxide, or another oxidant in solution, was added in a dropwise fashion over 10 minutes to a notional final concentration of $10^{-3}$M the pH being maintained at 10 during the addition. On reviewing the spectrum, the decrease in absorbance at the dye maximum wavelength was found to be 83%. Repeating the experiment with addition of hydrogen peroxide in one aliquot caused a decrease in absorbance of only 14.5% in the same time period. Corresponding results with other bleaching agents are given in the table below. The different degrees of bleaching by the bleaching agents were added in single aliquot are due to the intrinsic activity of the bleach (uncatalyzed). Thus hypochlorite has considerable effect when added in one aliquot, but is, of course, also very harsh in its effect upon dyed fabrics.

| Oxidant | Initial dye absorbance | Final dye absorbance | % destruction of dye |
|---|---|---|---|
| Oxone dropwise | .655 | .05 | 92.4 |
| Oxone 1 aliquot | .655 | .15 | 77.1 |
| P4* dropwise | .655 | .05 | 92.4 |
| P4* 1 aliquot | .655 | .31 | 52.7 |
| Peracetic acid dropwise | .655 | .25 | 61.8 |
| Peracetic acid 1 aliquot | .655 | .45 | 31.3 |
| NaOCl dropwise | .655 | .04 | 93.9 |
| NaOCl 1 aliquot | .655 | .05 | 92.4 |

*Metachloroperbenzoic acid

EXAMPLE 5

The test of Example 4 was carried out using dropwise addition of $H_2O_2$, but with the bleach bath maintained at pH 7.5. The decrease in dye absorbance was 88%.

EXAMPLE 6

Dye Transfer Inhibition

A detergent composition of formula given below was prepared.

| | |
|---|---|
| Sodium dodecylbenzene sulfonate | 11% |
| Tallow alcohol condensed with 11 molar proportions of ethylene oxide | 4% |
| Fatty acid (approximately $C_{18}$) | 5% |
| Sodium tripolyphosphate | 45% |
| Sodium silicate (solids) | 10% |
| Carboxymethylcellulose | 1% |
| Sodium sulfate | 15% |
| Moisture | 8% |
| Impurities and minors | 1% |
| | 100% |

A solution of concentration of 5.6g/l was prepared. Into 1000 ml of this solution were placed a piece of cotton terry cloth (5cm × 4cm) dyed with Durazol Red dye and a piece of white terry cloth (6cm × 6cm).

To the solution at 50° C, 10mg of FE(III)TPPS were added giving a concentration of $10^{-5}$M. 10mls. (10ppm by weight) of $H_2O_2$ were added over 10 minutes to give a final concentration of $10^{-3}$M. After 10 minutes, the cloths were removed and the originally white terry cloth was rinsed in cold water and air dried. The experiment was repeated with a series of oxidants: oxone, peracetic acid, NaOCl, metachloroperbenzoic acid. The color of the cloths was measured using a Hunter Color Difference Meter. The L, a and b values for each of the cloths washed were taken. The cloths were too small to measure directly, and so the Hunter meter was set up as per instructions, and the cloths placed under a cut-out made in a circle of black filter paper which was smaller than the cloths. As a result, the results obtained are comparable, but are not absolute. While the precise, interpretation of the L, a and b values is well known in the art, the table below will be more easily understood if it is remembered that a higher L value represents greater brightness of the test piece, high a value represents more redness, lower (more negative) b value represents more blueness.

| Cloth Treatment | Hunter Meter Values L | a | b |
|---|---|---|---|
| (1) Clean cloth (untreated) | 77.4 | + 2.1 | −3.8 |
| (2) Treated at 50° C with detergent composition only | 66.7 | +18.9 | −8.5 |
| (3) Treated at 50° C with composition + Fe (111) TPPS | 68.7 | +15.4 | −6.0 |
| (4) As (3) with dropwise addition of hydrogenperoxide | 72.4 | + 6.2 | −3.0 |
| (5) As (3) with dropwise addition of peracetic acid | 71.7 | + 9.6 | −5.7 |
| (6) As (3) with dropwise addition of oxone | 75.9 | + 2.3 | −1.6 |
| (7) As (3) with dropwise addition of sodium-hypochlorite* | 65.6 | − 0.2 | −0.7 |
| (8) As (3) with dropwise addition of metachloro-perbenzoic acid | 70.6 | + 7.2 | −6.1 |

*It is noticeable that this treatment prevented transfer of the red dye well ("a" value negative) but caused some darkening and yellowing of the Test Fabric. (a = −0.2)

These results are for example only and do not necessarily represent the best results that could be achieved with the stated bleaches.

Similar results were obtained when the dyed cloth test piece was dyed with the following dye stuffs listed in the Colour Index (3rd Edition):

Direct violet 47
Direct blue 40
Direct green 5

Using Direct brown 115, no dye transfer inhibition was observed.

With Erionyl red and Erionyl Blue (acid dyes) and Cibacet violet (disperse dye), good results were obtained in similar tests when nylon test pieces were used.

EXAMPLE 7

The procedure of Example 4, with dropwise addition of $H_2O_2$, was repeated with a catalyst derived from iron III tetra pyridyl porphyrin, named iron III tetra (methyl pyridyl) porphyrin, of formula:

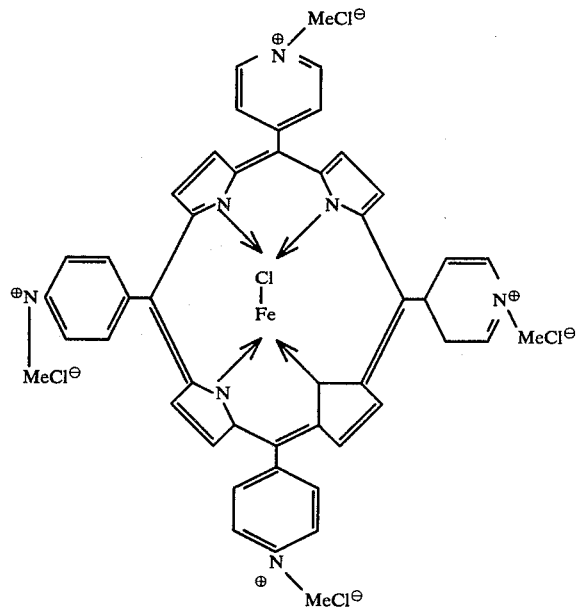

A decrease of 75% in Durazol red absorbance was observed.

EXAMPLE 8

Fe(III) phthalocyanine tri sulfonate

A solution with concentration of Fe(III) phthalocyanine tri sulfonate of 30mg/liter and concentration of Durazol red dye of 14mg/liter was prepared and the pH adjusted to 10. $H_2O_2$ was added dropwise over ten minutes to a final concentration of $10^{-3}$M, the pH being maintained at 10 throughout the dropwise addition by means of NaOH. The temperature was 25° C. The optical absorbance due to the Durazol red fell by 18% indicating catalytic behavior by the phthalocyanine.

EXAMPLE 9

Haemin chloride

A beaker-scale wash test was carried out at 50° C using Durazol red dyed terry cloth and white "pick up" terry cloth. The method was as described in Example 6. Haemin chloride at 10ppm was used as catalyst.

Hunter values were: L 70.2; a 8.1; b −6.0

These values were taken under the same conditions as in Example 6 and indicate a small positive effect of haemin chloride in reducing dye transfer when compared with result 2 in Example 6. Substantially similar results are obtained when the catalyst compound is a haemin chloride derivative wherein the propionic acid groups are ethoxylated.

EXAMPLE 10

The domestic washing machine test method of Example 3 is carried out using each of the following iron porphin catalyst compounds in the test solution. Carbon position numbering is based on Formula I.

| Compound | Substituent on Carbon 5 | Substituent on Carbon 10 | Substituent on Carbon 15 | Substituent on Carbon 20 | Substituent on Carbon 8 |
|---|---|---|---|---|---|
| A | H | H | H | H | $-C_2H_5$ |
| B | 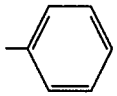 | H | H | H | H |
| C | 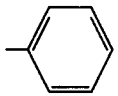 | 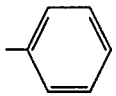 | 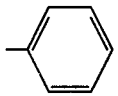 | 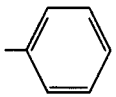 | H |
| D | 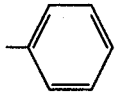 | H | 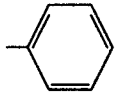 | H | H |
| E | H | H | H | 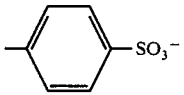 | H |
| F | H | 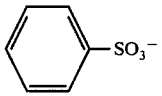 | H | 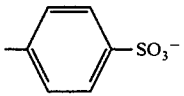 | $-CH_3$ |
| G | H | H | 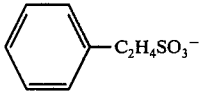 | H | H |
| H | 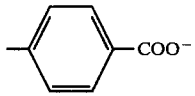 | 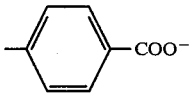 | 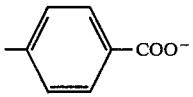 | 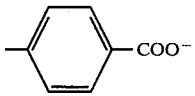 | H |
| I | H | H | H | 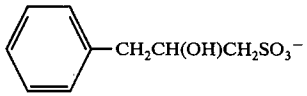 | H |
| J | 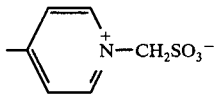 | H | H | H | H |
| K | 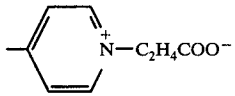 | 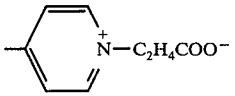 | 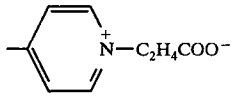 | 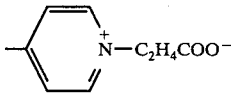 | H |

-continued
| Compound | Substituent on Carbon 5 | Substituent on Carbon 10 | Substituent on Carbon 15 | Substituent on Carbon 20 | Substituent on Carbon 8 |
|---|---|---|---|---|---|
| L | 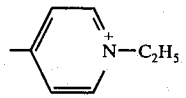 | H | H | H | $-CH_2OH$ |
Substantially similar results to those of Example 3 are achieved with each of the above catalyst compounds.

What is claimed is:

1. A process for washing fabrics which comprises treating them in a water bath containing a dissolved or solubilized catalyst compound selected from the group consisting of:

(a) iron porphin and water-soluble or water-dispersible derivatives thereof;

(b) haemin chloride and water-soluble or water-dispersible derivatives thereof;

(c) iron phthalocyanine and water-soluble or water-dispersible derivatives thereof; and (d) mixtures thereof;

the concentration of said compound being up to $10^{-4}$ molar and to which bath is also supplied an oxidizing bleaching agent, the amount of said bleaching agent supplied being equal to the amount which would give a concentration in the bleaching bath of up to $10^{-2}$ molar, said bleaching agent being released into the bleaching bath, after at least part of said compound has been dissolved or solubilized, at a rate not substantially greater than that at which it is removed from said bath by reaction with the contents thereof.

2. A process according to claim 1, containing an iron porphin derivative, wherein said iron porphin is substituted on at least one of its meso positions with a phenyl or pyridyl substituent selected from the group consisting of

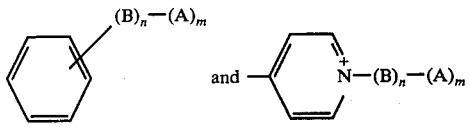

wherein $n$ and $m$ may be 0 or 1, A is selected from the group consisting of sulfate, sulfonate, phosphate and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

3. A process according to claim 2 wherein the phenyl or pyridyl group is substituted with a substituent selected from the group consisting of $—CH_3$, $—C_2H_5$, $—CH_2CH_2CH_2SO_3^-$, $—CH_2COO^-$ and $—CH_2CH(OH)CH_2SO_3^-$.

4. A process according to claim 2 wherein said catalyst compound is ferric tetrasulfonated tetraphenyl porphin.

5. A process according to claim 1 wherein the concentration of said catalyst compound is from $10^{-6}$ to $10^{-4}$ molar.

6. A process according to claim 5 wherein the molar ratio of oxidizing agent to said catalytic compound is from 5:1 to 10,000:1.

7. A process according to claim 6 wherein the amount of bleaching agent supplied is equal to the amount which would give a concentration in the bleaching bath of at least $5 \times 10^{-5}$ molar.

8. A process according to claim 7 wherein said concentration is from $5 \times 10^{-4}$ to $1.5 \times 10^{-3}$ molar.

9. A process according to claim 8 wherein the bleaching agent is released gradually into the bath over a period of 5 to 30 minutes.

10. A process according to claim 9 which is carried out at a temperature in the range of from 5° C to 75° C.

11. A process according to claim 10 wherein the pH of the bleaching bath is from 7 to 11.

12. A process according to claim 11 wherein the pH of the bleaching bath is from 9 to 11.

13. A process according to claim 12 where said bleaching agent is one which provides hydrogen peroxide as the active principle in the bleaching bath.

14. A process according to claim 13 wherein said catalytic compound is added to the bleaching bath in association with additional components selected from the group consisting of organic surface active agents, detergency builder salts, or mixtures thereof.

15. A bleaching composition comprising:

(a) an oxidizing bleaching agent; and (b) a catalyst compound selected from the group consisting of:

(i) iron porphins and water-soluble or water-dispersible derivatives thereof;

(ii) haemin chloride and water-soluble or water-dispersible derivatives thereof;

(iii) iron phthalocyanine and water-soluble or water-dispersible derivatives thereof; and (iv) mixtures thereof;

the bleaching agent being in a form such that it is released into the bleaching solution at a rate not substantially greater than that at which it is removed by reaction with the contents thereof.

16. A composition according to claim 15, containing an iron porphin derivative, wherein said iron porphin is substituted on at least one of its meso positions with a phenyl or pyridyl substituent selected from the group consisting of

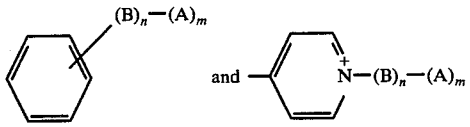

wherein $n$ and $m$ may be 0 or 1, A is selected from the group consisting of sulfate, sulfonate, phosphate, and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

17. A composition according to claim 16 wherein the phenyl or pyridyl group is substituted with a substituent selected from the group consisting of $—CH_3$, $—C_2H_5$, $—CH_2CH_2CH_2SO_3^-$, $—CH_2COO^-$, and $—CH_2CH(OH)CH_2SO_3^-$.

18. A composition according to claim 16 wherein the catalyst compound is ferric tetrasulfonated tetraphenylporphin.

19. A composition according to claim 15 wherein the molar ratio of oxidizing agent to catalyst compound is from 5:1 to 10,000:1.

20. A composition according to claim 19 wherein the bleaching agent is selected from the group consisting of hydrogen peroxide and substances which provide hydrogen peroxide in aqueous solution.

21. A composition according to claim 20 wherein the bleaching agent is a persalt.

22. A composition according to claim 21 which contains from 0.01 to 3% available oxygen by weight in the form of one or more persalts.

23. A composition according to claim 22 which contains from 0.01 to 1% available oxygen by weight in the form of one or more persalts.

24. A composition according to claim 23 wherein the bleaching agent is solid and is in such form that it dissolves in the bleaching solution over a period of not less than 1 minute at 5° C.

25. A composition according to claim 24 wherein the bleaching agent comprises a perhydrate coated with from about 10% to 20% by weight of tallow alcohol.

26. A composition according to claim 15 which also contains one or more adjuvants selected from the group consisting of organic surface-active agents, detergency builder salts, other conventional components of detergent compositions, and mixtures thereof.

27. A composition according to claim 15 wherein the molar ratio of oxidizing agent to catalyst compound is from 10:1 to 100:1.

28. A process according to claim 5 wherein the molar ratio of oxidizing agent to catalyst compound is from 10:1 to 100:1.

* * * * *

UNITED STATES PATENT AND TRADEMARK OFFICE

CERTIFICATE OF CORRECTION

PATENT NO. : 4,077,768

DATED : March 7, 1978

INVENTOR(S) : JAMES PYOTT JOHNSTON, JOHN ROBERT TATE

It is certified that error appears in the above-identified patent and that said Letters Patent are hereby corrected as shown below:

Abstract, line 4, "phorphins" should be -- porphins --.

Column 3, line 1 "$-CH_2$--" should be -- $-CH_2COO^-$ --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*